US011013263B2

(12) United States Patent
Wu et al.

(10) Patent No.: US 11,013,263 B2
(45) Date of Patent: May 25, 2021

(54) ELECTRONIC CIGARETTE AND POWER SUPPLY DEVICE

(71) Applicant: SHENZHEN SMOORE TECHNOLOGY LIMITED, Shenzhen (CN)

(72) Inventors: Zhenyu Wu, Shenzhen (CN); Guoliang Ou, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 257 days.

(21) Appl. No.: 16/278,139

(22) Filed: Feb. 17, 2019

(65) Prior Publication Data

US 2019/0373951 A1 Dec. 12, 2019

(30) Foreign Application Priority Data

Jun. 12, 2018 (CN) ..... 201820908996.X

(51) Int. Cl.
*A24F 40/60* (2020.01)
*A24F 40/40* (2020.01)
*A24F 40/10* (2020.01)

(52) U.S. Cl.
CPC ..... *A24F 40/60* (2020.01); *A24F 40/40* (2020.01); *A24F 40/10* (2020.01)

(58) Field of Classification Search
CPC ..... A24F 40/60; A24F 40/40; A24F 40/10
USPC ..... 131/329
See application file for complete search history.

(56) References Cited

U.S. PATENT DOCUMENTS

| | | | | |
|---|---|---|---|---|
| 9,247,773 | B2 * | 2/2016 | Memari | A24F 47/008 |
| 9,271,526 | B2 * | 3/2016 | Liu | A24F 15/12 |
| 9,462,831 | B2 * | 10/2016 | Liu | A24F 47/008 |
| 9,538,789 | B2 * | 1/2017 | Liu | A24F 47/008 |
| 9,675,107 | B2 * | 6/2017 | Levitz | F16B 7/0446 |
| 9,756,876 | B2 * | 9/2017 | Liu | A24F 47/002 |
| 9,763,478 | B2 * | 9/2017 | Cameron | H04M 1/72533 |
| 9,861,133 | B2 * | 1/2018 | Li | A24F 47/008 |
| 9,888,724 | B2 * | 2/2018 | Cameron | G06F 3/165 |
| 9,936,732 | B2 * | 4/2018 | Liu | A24F 47/008 |
| 10,136,677 | B2 * | 11/2018 | Qiu | H05B 1/02 |
| 10,314,339 | B2 * | 6/2019 | Fraser | A24F 40/485 |
| 10,412,994 | B2 * | 9/2019 | Schennum | A24F 47/008 |

(Continued)

*Primary Examiner* — Alexander Gilman
(74) *Attorney, Agent, or Firm* — Hemisphere Law, PLLC; Zhigang Ma

(57) ABSTRACT

An electronic cigarette and a power supply device, having a power supply body provided with a receiving portion thereon; the receiving portion has a receiving chamber for accommodating an atomization device and an extending opening for a holder of the atomization device to extend outwards. The receiving chamber is internally provided with a connection assembly comprising a mounting seat for a connection joint to be detachably connected on the atomization device; the mounting seat is rotatably disposed with the atomization device, and the receiving chamber is internally provided with a position-limit mechanism defining a rotation range of the mounting seat. The atomization device and the mounting seat can be rotated to adjust a direction of rotation of the flat cigarette holder on the atomization device after the atomization device is connected to the mounting seat so as to meet different smoking needs of users.

20 Claims, 7 Drawing Sheets

(56) References Cited

U.S. PATENT DOCUMENTS

| | | | | |
|---|---|---|---|---|
| 10,433,584 | B2 * | 10/2019 | Nettenstrom | A24F 47/008 |
| 10,477,899 | B2 * | 11/2019 | Qiu | A24F 47/008 |
| 10,495,226 | B2 * | 12/2019 | Chen | F16J 15/021 |
| 10,765,150 | B2 * | 9/2020 | Qiu | A24F 47/008 |
| 10,863,771 | B2 * | 12/2020 | Borkovec | A24F 47/008 |
| 10,863,772 | B2 * | 12/2020 | Borkovec | A24F 40/48 |
| 10,865,095 | B2 * | 12/2020 | Scott | B67D 7/44 |
| 2015/0020828 | A1 * | 1/2015 | Liu | A24F 47/008 131/329 |

* cited by examiner

ELECTRONIC CIGARETTE AND POWER SUPPLY DEVICE

TECHNICAL FIELD

The present application relates to a cigarette substitute, and more particularly to an electronic cigarette and a power supply device.

BACKGROUND

With the development of electronic cigarettes, an increasing types and shapes of electronic cigarette products are provided. An existing electronic cigarette includes a power supply device and an atomizer with a holder. The power supply device has a receiving chamber for receiving a portion of the atomizer in the receiving chamber and exposing the holder to the receiving chamber for the usage of a user.

However, when the atomizer with the holder is connected to the power supply device, the user cannot adjust the angle of the holder when holding the smoking article, and when some small-sized atomizers are installed in the receiving chamber, the holder of the atomizer cannot be exposed out of the receiving chamber, or only a small portion of the holder are exposed out of the receiving chamber, which is inconvenient for the user.

Therefore, it is highly necessary to provide a new connection device for the electronic smoking article for the convenience of the user.

BRIEF SUMMARY

The technical problem to be solved by the present application is to provide an electronic cigarette and a power supply device.

The technical solution adopted by the present application for solving the technical problem thereof is to construct a power supply device for an electronic cigarette, comprising a power supply body, provided with an receiving portion having a receiving chamber for accommodating an atomization device and an extending opening for a holder of the atomization device to extend outwards; the receiving chamber is internally provided with a connection assembly comprising a mounting seat for a connection joint to be detachably connected on the atomization device;

The mounting seat is rotatably disposed with the atomization device, and the receiving chamber is internally provided with a position-limit mechanism defining a rotation range of the mounting seat.

Preferably, the position-limit mechanism comprises a rotating member connected to and capable of rotating synchronously with the mounting seat, and a stopping member mounted in the receiving portion; the rotating member and the stopping member are rotatably engaged with each other and define the rotation range of the mounting seat.

Preferably, the rotating member is provided with an arc-shaped rotating slot along a rotation direction of the mounting seat, and the stopping member is provided with a stopping projection clamped in the rotating slot.

Preferably, the stopping member and the rotating member are both annular; the rotating slot is disposed along a circumferential direction of the rotating member, and a partition wall for partitioning the rotating slot is provided between the two ends of the rotating slot.

Preferably, the stopping member and the rotating member are stacked in the direction of the rotation axis of the mounting seat; the rotating member is sandwiched between the stopping member and the mounting seat, and the stopping member is disposed at a bottom of the receiving chamber opposite to the extending opening; the rotating slot and the stopping projection are respectively located at two adjacent sides of the rotating member and the stopping member.

Preferably, a first locating slot is provided on the side of the mounting seat adjacent to the rotating member, and a first locating projection clamped into the first locating slot is provided on the rotating member so as to locate the mounting seat and the rotating member circumferentially;

The connection assembly further comprises a base having a cylindrical body in which the mounting seat, the rotating member and the stopping member are all mounted; the stopping member is provided with a second locating projection, and the base is provided with a second locating slot for the second locating projection to be clamped in.

Preferably, the connection joint is in a threaded engagement with the mounting seat.

Preferably, an indicator light is disposed on one sidewall surface of the power supply body, and the indicator light and an exposed portion of the atomization device mounted on the power supply body are located on the same side of the power supply body.

Preferably, the power supply device further comprises a microphone and a motor electrically connected to the atomization device installed in the receiving portion.

An electronic cigarette, comprising the power supply device and the atomization device detachably mounted in the receiving chamber; the connection joint and the mounting seat are correspondingly connected.

The electronic cigarette and the power supply device of the present application have the following beneficial effects:

the atomization device and the mounting seat can be rotated to adjust the direction of rotation of the flat cigarette holder on the atomization device after the atomization device is connected to the mounting seat so as to meet different smoking needs of users.

BRIEF DESCRIPTION OF THE DRAWINGS

The present application will be further described below in combination with the accompanying drawings and embodiments, in the drawings.

DETAILED DESCRIPTION

For a better understanding of the technical features, objects and effects of the present application, the specific embodiments of the present application will be described in detail with reference to the accompanying drawings.

Figure 1:
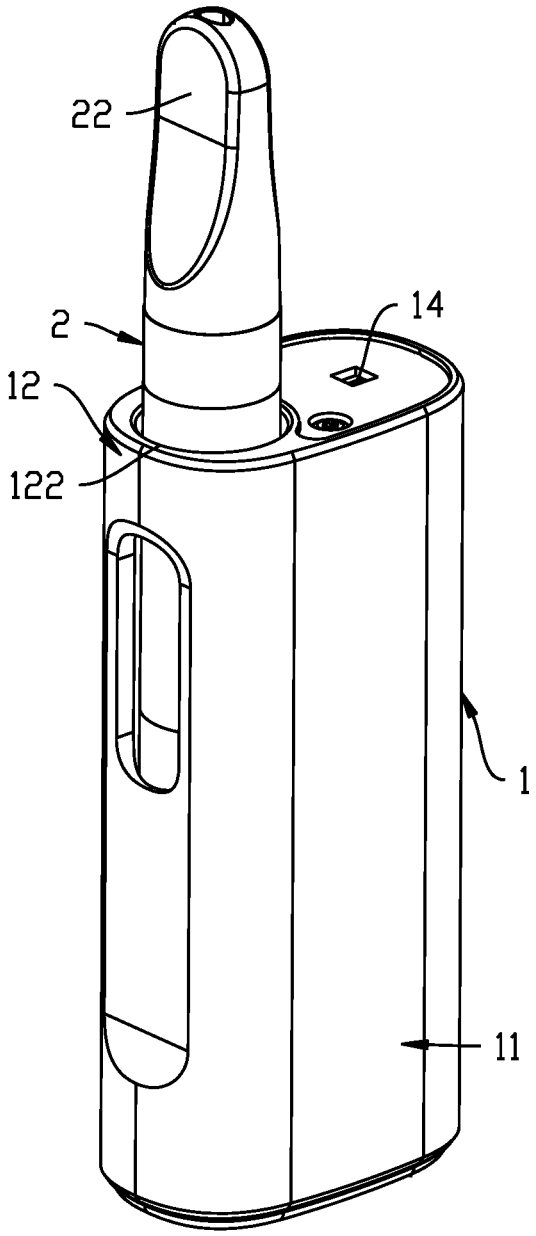
FIG. 1 is a schematic view showing a three-dimensional structure of an atomization device after being inserted into a receiving chamber of a power supply device according to an embodiment of the present application.
Figure 2:
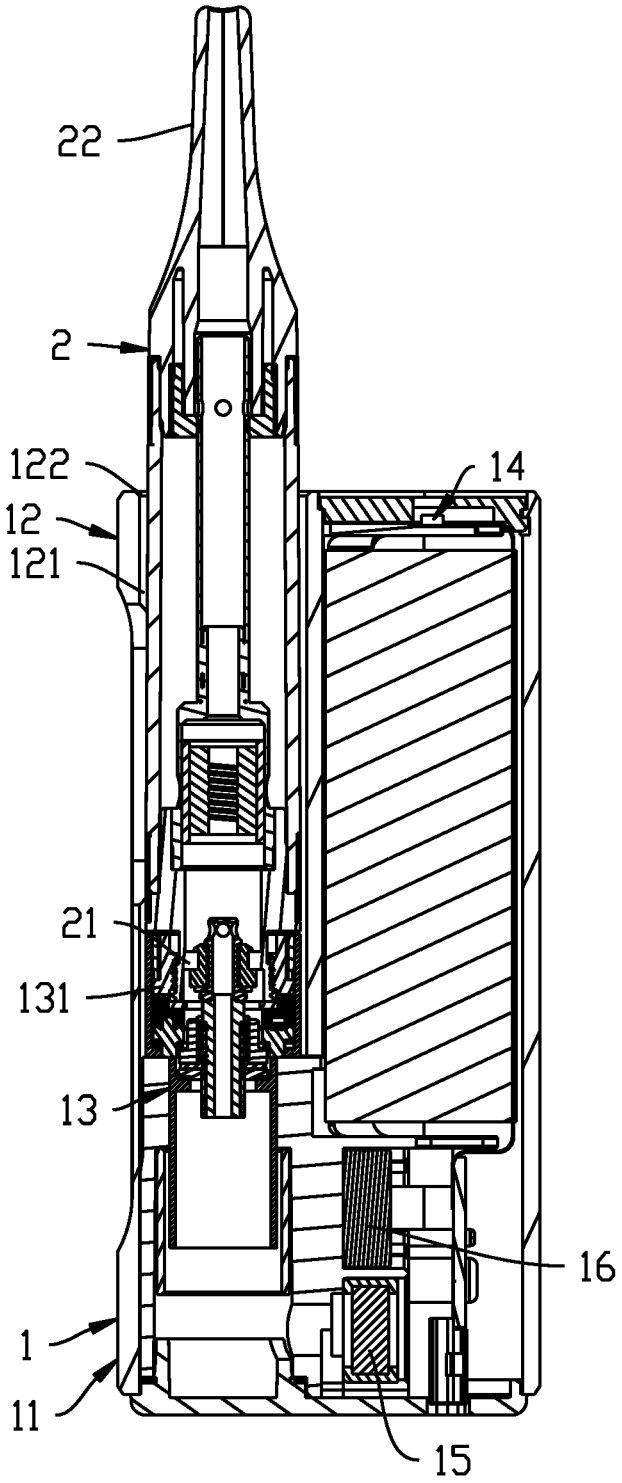
FIG. 2 is a cross-sectional structural view of the atomization device and the power supply device of FIG. 1 assembled.
Figure 3:
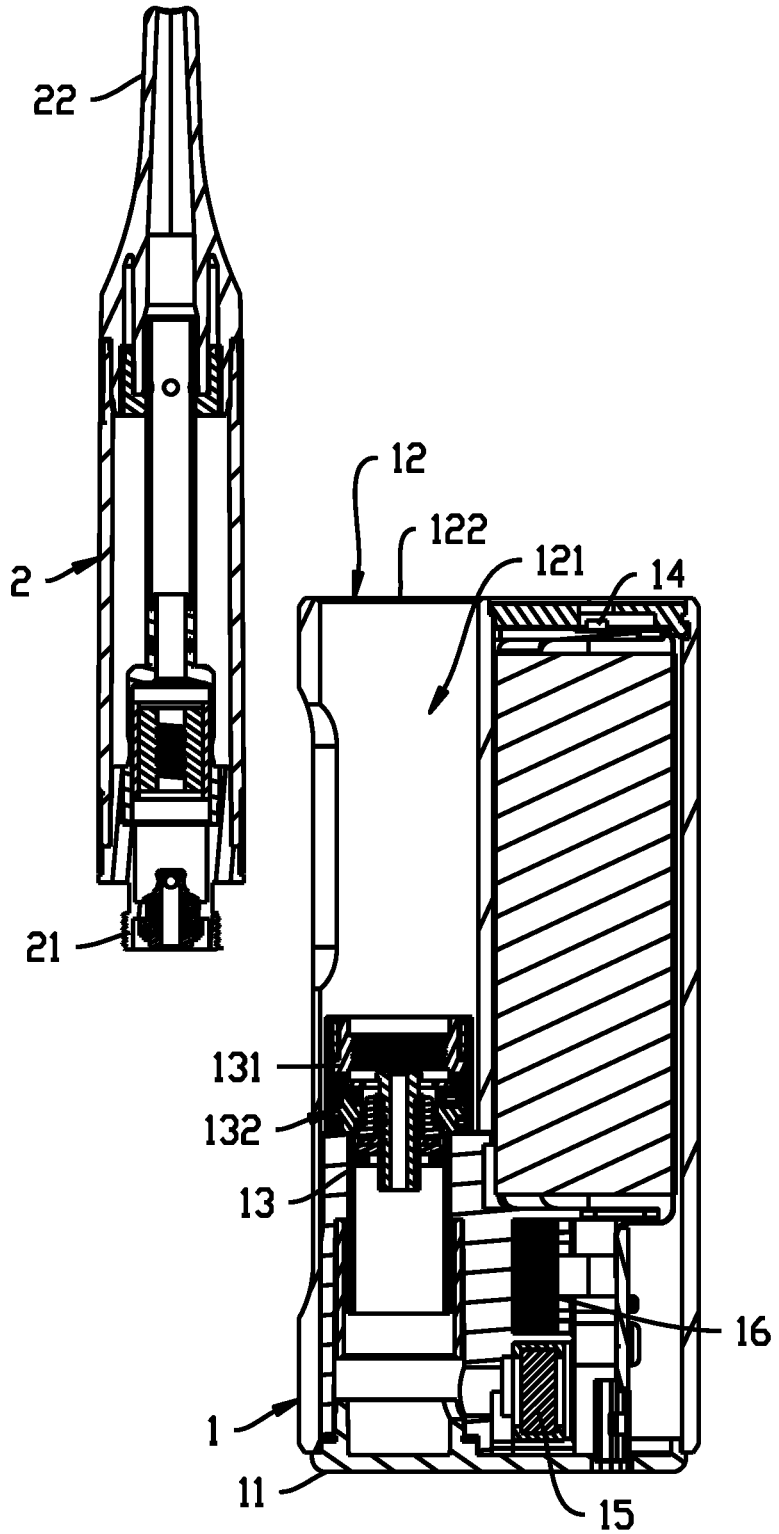
FIG. 3 is an exploded schematic view of the atomization device and the power supply device of FIG. 2.
Figure 4:
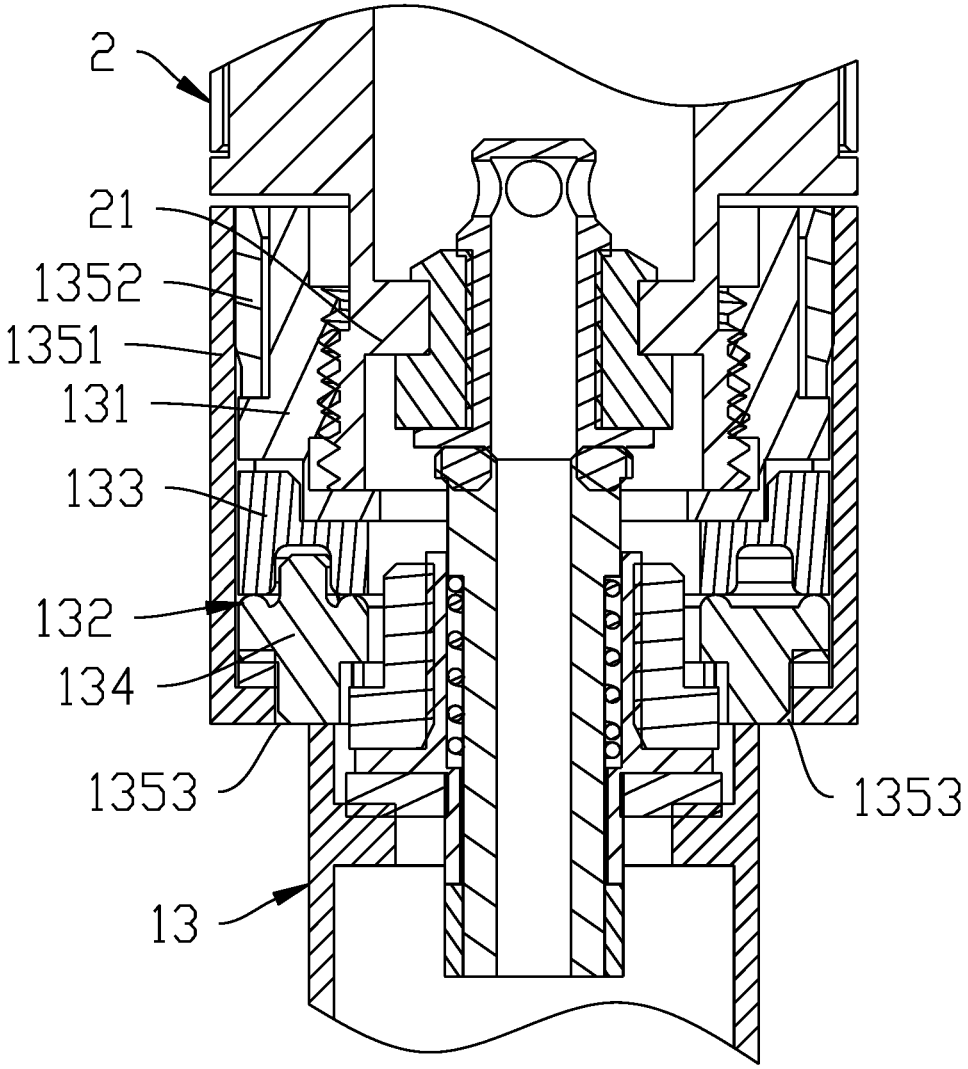
FIG. 4 is a partial schematic view of the atomization device of FIG. 2 with the connection assembly connected.
Figure 5:
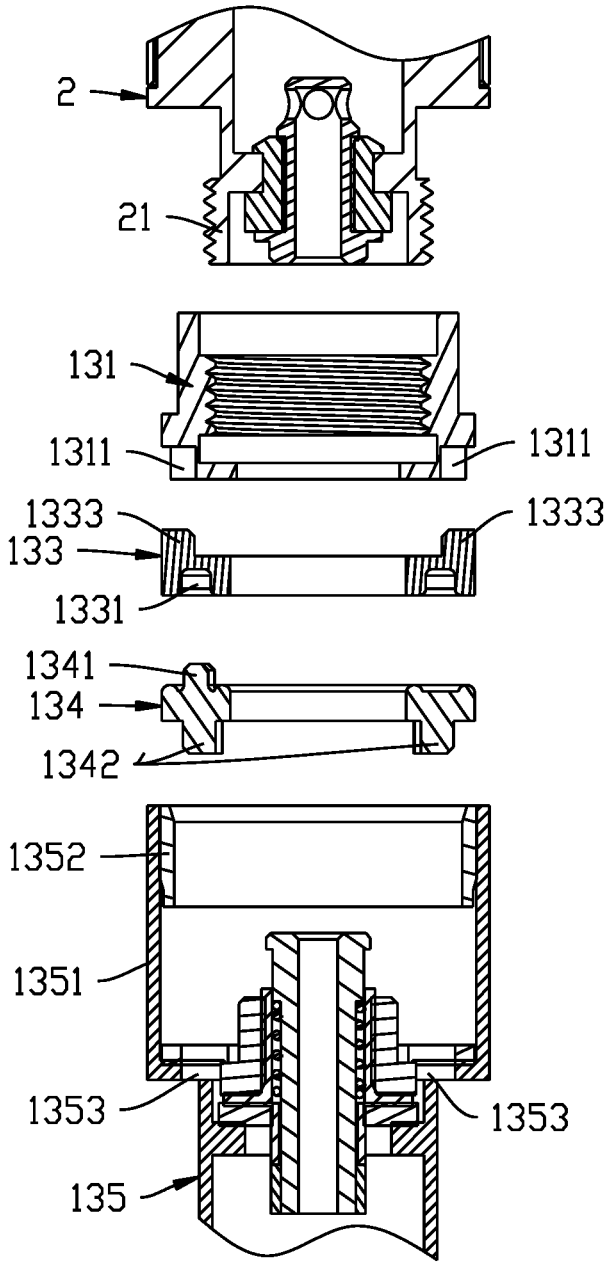
FIG. 5 is an exploded schematic view of the atomization device and the connection assembly of FIG. 4.
Figure 6:
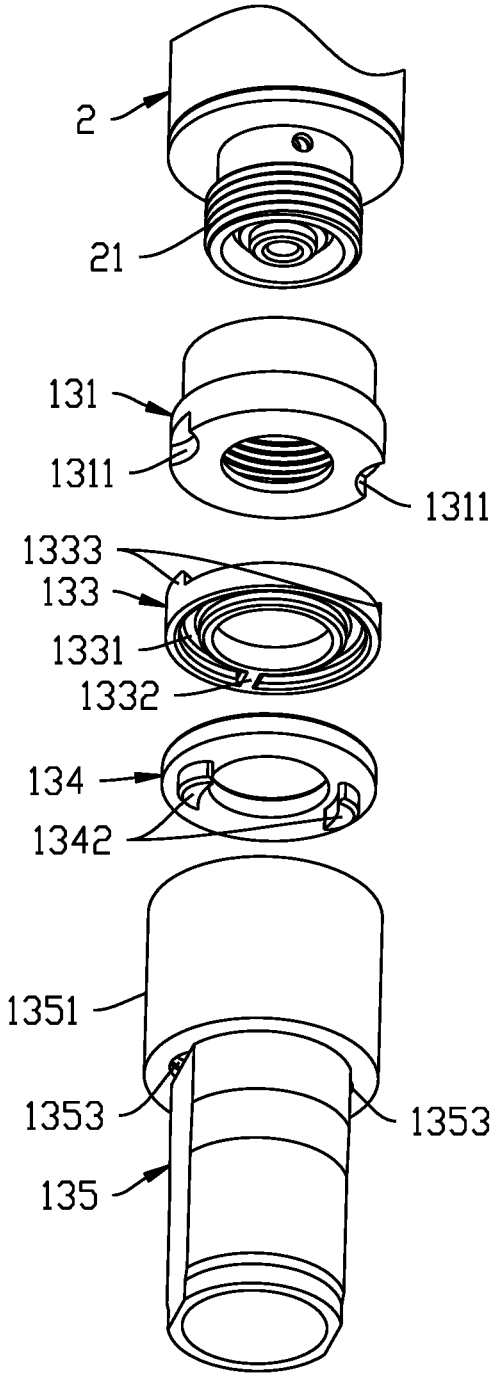
FIG. 6 is an exploded perspective view of the atomization device and the connection assembly of FIG. 5.
Figure 7:
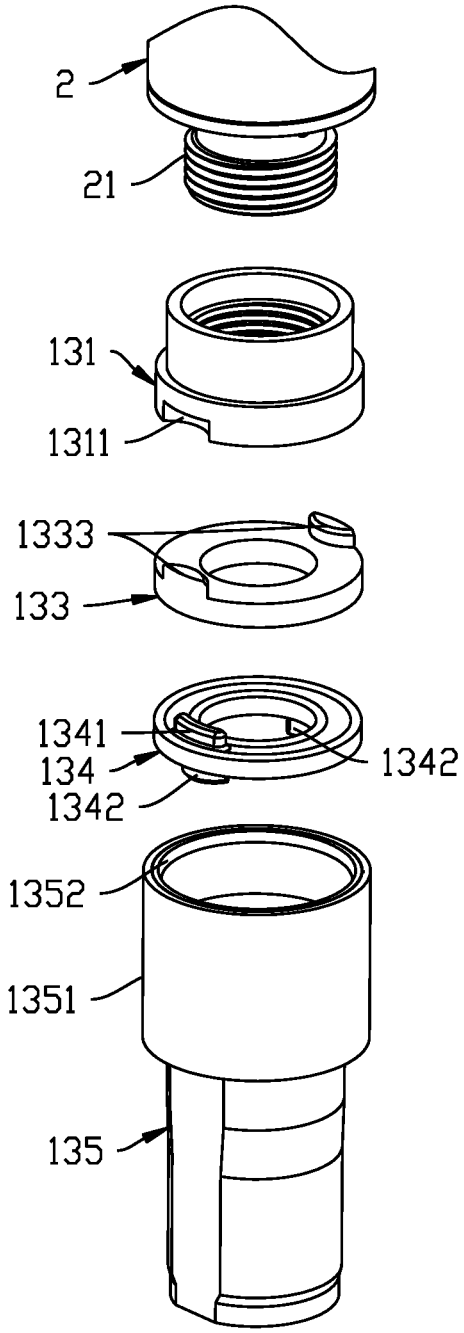
FIG. 7 is an exploded perspective view of the atomization device and connection assembly of FIG. 5 from another aspect.

As shown in FIGS. 1 to 3, an electronic cigarette in a preferred embodiment of the present application includes a power supply device 1 and an atomization device 2 detachably mounted to the power supply device 1; the power supply device 1 supplies power to the atomization device 2 and allows the atomization device 2 to heat the atomizer cigarette liquid for the user.

The power supply device 1 includes a power supply body 11 provided with an receiving portion 12 having a receiving chamber 121 for accommodating the atomization device 2 and an extending opening 122 for a holder 22 of the atomization device 2 to extend outwards. The receiving chamber 121 is provided with a connection assembly 13 comprising a mounting seat 131 for a connection joint 21 of the atomization device 2 to be detachably connected.

Normally, the connection joint 21 and the mounting seat 131 are electrically connected after the atomization device 2 is mounted to the power supply device 1. The mounting seat 131 is rotatably disposed with the atomization device 2, and the receiving chamber 121 is provided with a position-limit mechanism 132 defining a rotation range of the mounting seat 131.

The atomization device 2 and the mounting seat 131 can be rotated to adjust the direction of rotation of the flat cigarette holder 22 on the atomization device 2 after the atomization device 2 is connected to the mounting seat 131 so as to meet different smoking needs of users.

As shown in FIGS. 4 to 7, preferably, the connection joint 21 is in a threaded engagement with the mounting seat 131, and the rotation range of the mounting seat 131 is less than one rotation. Before the connection joint 21 is screwed to the mounting seat 131, the mounting seat 131 can be located after being rotated at a certain angle in the circumferential direction, and then the screwing is started; before the connecting joint 21 is withdrawn from the mounting seat 131, the mounting seat 131 can be located after being rotated at a certain angle in the opposite direction to the circumferential direction, so that the direction of the flat cigarette holder 22 on the atomization device 2 can be adjusted by the rotating mounting seat 131. In this embodiment, the mounting seat 131 can be rotated approximately one revolution in the circumferential direction to satisfy the requirement of the rotation angle of the atomization device 2 in all directions.

The position-limit mechanism 132 comprises a rotating member 133 connected to and capable of rotating synchronously with the mounting seat 131, and a stopping member 134 mounted in the receiving portion 12; the rotating member 133 and the stopping member 134 are rotatably engaged with each other and define the rotation range of the mounting seat 131.

Further, in order to define the rotation range of the mounting seat 131, the rotating member 133 is provided with an arc-shaped rotating slot 1331 along a rotation direction of the mounting seat 131, and the stopping member 134 is provided with a stopping projection 1341 clamped in the rotating slot 1331. The angle of the arc-shaped rotating slot 1331 defines the rotation range of the mounting seat 131.

Preferably, the stopping member 134 and the rotating member 133 are both annular; the rotating slot 1331 is disposed along a circumferential direction of the rotating member 133, and a partition wall 1332 for partitioning the rotating slot 1331 is provided between the two ends of the rotating slot 1331. The thickness of the partition wall 1332 may determine the arc of the rotating slot 1331, i.e., the rotation range of the mounting seat 131 and the atomization device 2; the less thickness of the partition wall 1332, the closer the rotation range of the mounting seat 131 and the atomization device 2 is to a complete revolution.

In other embodiments, the stopping member 134 and the rotating member 133 may not be completely annular, and may serve to define the mounting seat 131 and the atomization device 2 within a certain rotation range. The stopping member 134 and the rotating member 133 may also be sleeved with each other; the rotating slot 1331 and the stopping projection 1341 are disposed on the adjacent sidewall surfaces, cooperating to define the rotation range.

When the atomization device 2 is screwed into the connection assembly 13, after the partition wall 1332 of the rotating member 133 abuts against one side of the stopping projection 1341 of the stopping member 134, the rotating member 133 is relatively stationary with the stopping member 134, and the atomization device 2 can continue to be screwed into the mounting seat 131.

When the atomization device 2 comes out of the connection assembly 13, the partition wall 1332 of the rotating member 133 abuts against the other side of the stopping projection 1341 of the rotating member 133, the rotating member 133 is relatively stationary with the stopping member 134, and the atomization device 2 can rotate out of the mounting seat 131.

In some embodiments, the stopping member 134 and the rotating member 133 are stacked in the direction of the rotation axis of the mounting seat 131; the rotating member 133 is sandwiched between the stopping member 134 and the mounting seat 131, and the stopping member 134 is disposed at a bottom of the receiving chamber 121 opposite to the extending opening 122; the rotating slot 1331 and the stopping projection 1341 are respectively located at two adjacent sides of the rotating member 133 and the stopping member 134.

The stopping member 134, the rotating member 133, and the mounting seat 131 are axially arranged so that the connection assembly 13 occupies a part of the space in the axial direction, thereby reducing the depth of the receiving chamber 121; because of the shorter atomization device 2, the holder 22 can be easily exposed for usage.

A first locating slot 1311 is provided on the side of the mounting seat 131 adjacent to the rotating member 133, and a first locating projection 1333 clamped into the first locating slot 1311 is provided on the rotating member 133 so as to locate the mounting seat 131 and the rotating member 133 circumferentially;

The connection assembly 13 further comprises a base 135 mounted at the bottom of the receiving chamber 121. The base 135 comprises a cylindrical body 1351 in which the mounting seat 131, the rotating member 133 and the stopping member 134 are all mounted; the inner ring at the end of the cylindrical body 1351 close to the extending opening 122 is provided with a position-limit ring 1352 to prevent the mounting seat 131, the rotating member 133 and the stopping member 134 from coming out.

The stopping member 134 is provided with a second locating projection 1342, and the base 135 is provided with a second locating slot 1353 for the second locating projection 1342 to be clamped in.

As shown in FIGS. 1 to 3, an indicator light 14 is disposed on one sidewall surface of the power supply body 11, and the indicator light 14 and an exposed portion of the atomization device 2 mounted on the power supply body 11 are located on the same side of the power supply body 11, so that the indicator light 14 can be observed when the user is smoking.

The power supply device 1 further comprises a microphone 15 and a motor 16 electrically connected to the atomization device 2 installed in the receiving portion 12. The microphone 15 and the motor 16 are disposed on the side of the power supply device 1. The atomization device 2 does not directly contaminate the microphone 15 and the motor 16 if liquid leakage occurs, thereby ensuring the normal operation of the microphone 15 and the motor 16.

It will be understood that each of the above-mentioned technical features may be used in any combination without limitation.

The forgoing is merely embodiments of the present invention, and thus does not limit the patent scope of the present invention. Any equivalent structure or equivalent flow transformation made according to the contents of the description and the drawings of the present application or any direct or indirect application to other related arts shall be also included in the patent protection scope of the present application.

What is claimed is:

1. A power supply device for an electronic cigarette, comprising a power supply body (11), the power supply body (11) being provided with an receiving portion (12) thereon, the receiving portion (12) having a receiving chamber (121) for accommodating an atomization device (2) and an extending opening (122) for a holder (22) of the atomization device (2) to extend outwards; wherein, the receiving chamber (121) is internally provided with a connection assembly (13) comprising a mounting seat (131) for a connection joint (21) of the atomization device (2) to be detachably connected such that, once connected, the atomization device (2) and the mounting seat (131) are able to rotate together; the receiving chamber (121) is internally provided with a position-limit mechanism (132) defining a rotation range of the mounting seat (131), and a range of the rotation of the atomization device (2) and the mounting seat (131) are limited by the defined rotation range.

2. The power supply device of claim 1, wherein, the position-limit mechanism (132) comprises a rotating member (133) and a stopping member (134), wherein the rotating member (133) is connected to and capable of rotating synchronously with the mounting seat (131), and the stopping member (134) is mounted in the receiving portion (12), and the rotating member (133) and the stopping member (134) are rotatably engaged with each other and define the rotation range of the mounting seat (131).

3. The power supply device of claim 2, wherein, the rotating member (133) is provided with an arc-shaped rotating slot (1331) along the rotation direction of the mounting seat (131), and the stopping member (134) is provided with a stopping projection (1341) clamped into the rotating slot (1331).

4. The power supply device of claim 3, wherein, the stopping member (134) and the rotating member (133) are both annular, the rotating slot (1331) is disposed along a circumferential direction of the rotating member (133), and a partition wall (1332) for partitioning the rotating slot (1331) is provided between the two ends of the rotating slot (1331).

5. The power supply device of claim 4, wherein, the stopping member (134) and the rotating member (133) are stacked in the direction of a rotation axis of the mounting seat (131); the rotating member (133) is sandwiched between the stopping member (134) and the mounting seat (131), and the stopping member (134) is disposed at a bottom of the receiving chamber (121) opposite to the extending opening (122); and the rotating slot (1331) and the stopping projection (1341) are respectively located at two adjacent sides of the rotating member (133) and the stopping member (134).

6. The power supply device of claim 5, wherein, a first locating slot (1311) is provided on the side of the mounting seat (131) adjacent to the rotating member (133), and a first locating projection (1333) clamped into the first locating slot (1311) is provided on the rotating member (133) so as to locate the mounting seat (131) and the rotating member (133) circumferentially; and the connection assembly (13) further comprises a base (135) having a cylindrical body (1351) in which the mounting seat (131), the rotating member (133) and the stopping member (134) are all mounted; and the stopping member (134) is provided with a second locating projection (1342), and the base (135) is provided with a second locating slot (1353) for the second locating projection (1342) to be clamped in.

7. The power supply device of claim 3, wherein the connection joint (21) is in a threaded engagement with the mounting seat (131).

8. The power supply device of claim 3, wherein, an indicator light (14) is disposed on one sidewall surface of the power supply body (11), and the indicator light (14) and an exposed portion of the atomization device (2) mounted on the power supply body (11) are located on the same side of the power supply body (11).

9. The power supply device of claim 3, wherein the power supply device (1) further comprises a microphone (15) and a motor (16) which are electrically connected to the atomization device (2) mounted in the receiving portion (12).

10. The power supply device of claim 2, wherein the connection joint (21) is in a threaded engagement with the mounting seat (131).

11. The power supply device of claim 2, wherein, an indicator light (14) is disposed on one sidewall surface of the power supply body (11), and the indicator light (14) and an exposed portion of the atomization device (2) mounted on the power supply body (11) are located on the same side of the power supply body (11).

12. The power supply device of claim 2, wherein the power supply device (1) further comprises a microphone (15) and a motor (16) which are electrically connected to the atomization device (2) mounted in the receiving portion (12).

13. The power supply device of claim 1, wherein the connection joint (21) is in a threaded engagement with the mounting seat (131).

14. The power supply device of claim 1, wherein, an indicator light (14) is disposed on one sidewall surface of the power supply body (11), and the indicator light (14) and an exposed portion of the atomization device (2) mounted on the power supply body (11) are located on the same side of the power supply body (11).

15. The power supply device of claim 1, wherein the power supply device (1) further comprises a microphone (15) and a motor (16) which are electrically connected to the atomization device (2) mounted in the receiving portion (12).

16. An electronic cigarette, comprising a power supply device (1), the power supply device comprising a power supply body (11), the power supply body (11) being provided with an receiving portion (12) thereon, the receiving portion (12) having a receiving chamber (121) for accommodating an atomization device (2) and an extending opening (122) for a holder (22) of the atomization device (2) to extend outwards; wherein, the receiving chamber (121) is internally provided with a connection assembly (13) comprising a mounting seat (131) for a connection joint (21) of the atomization device (2) to be detachably connected such that the atomization device (2) and the mounting seat (131) are able to rotate together; the receiving chamber (121) is internally provided with a position-limit mechanism (132) defining a rotation range of the mounting seat (131), and a range of the rotation of the atomization device (2) and the mounting seat (131) are limited by the defined rotation range.

17. The electronic cigarette of claim 16, wherein, the position-limit mechanism (132) comprises a rotating member (133) and a stopping member (134), wherein the rotating member (133) is connected to and capable of rotating synchronously with the mounting seat (131), and the stopping member (134) is mounted in the receiving portion (12), and the rotating member (133) and the stopping member (134) are rotatably engaged with each other and define the rotation range of the mounting seat (131).

18. The electronic cigarette of claim 17, wherein, the rotating member (133) is provided with an arc-shaped rotating slot (1331) along the rotation direction of the mounting seat (131), and the stopping member (134) is provided with a stopping projection (1341) clamped into the rotating slot (1331).

19. The electronic cigarette of claim 18, wherein, the stopping member (134) and the rotating member (133) are both annular, the rotating slot (1331) is disposed along a circumferential direction of the rotating member (133), and a partition wall (1332) for partitioning the rotating slot (1331) is provided between the two ends of the rotating slot (1331).

20. The electronic cigarette of claim 19, wherein, the stopping member (134) and the rotating member (133) are stacked in the direction of a rotation axis of the mounting seat (131); the rotating member (133) is sandwiched between the stopping member (134) and the mounting seat (131), and the stopping member (134) is disposed at a bottom of the receiving chamber (121) opposite to the extending opening (122); and the rotating slot (1331) and the stopping projection (1341) are respectively located at two adjacent sides of the rotating member (133) and the stopping member (134).

* * * * *